United States Patent [19]

Hayman et al.

[11] 4,156,042

[45] May 22, 1979

[54] COATING ARTICLES HAVING FINE BORES OR NARROW CAVITIES IN A PACK-CEMENTATION PROCESS

[75] Inventors: Cecil Hayman, Rickmansworth; James E. Restall, Camberley, both of England

[73] Assignee: The Secretary of State for Defence in Her Britannic Majesty's Government of the United Kingdom of Great Britain and Northern Ireland, London, England

[21] Appl. No.: 880,128

[22] Filed: Feb. 22, 1978

Related U.S. Application Data

[63] Continuation-in-part of Ser. No. 672,952, Apr. 2, 1976, abandoned.

[30] Foreign Application Priority Data

Apr. 4, 1975 [GB] United Kingdom ..... 14011/75

[51] Int. Cl.[2] ..... C23C 9/02

[52] U.S. Cl. ..... 427/253; 118/49; 148/6.3

[58] Field of Search ..... 427/253, 295, 297; 148/6.3

[56] References Cited

U.S. PATENT DOCUMENTS

| | | | |
|---|---|---|---|
| 2,210,832 | 8/1940 | Bright | 427/297 |
| 3,079,276 | 2/1963 | Puyear et al. | 427/253 |
| 3,158,499 | 11/1964 | Jenkins | 427/237 X |
| 3,257,230 | 6/1966 | Wachtell | 427/250 |
| 3,343,982 | 9/1967 | Maxwell et al. | 427/253 |
| 3,373,018 | 3/1968 | Oxley et al. | 427/253 |

FOREIGN PATENT DOCUMENTS

| | | | |
|---|---|---|---|
| 1147101 | 4/1963 | Fed. Rep. of Germany | 427/252 |
| 1070396 | 6/1967 | United Kingdom | 427/295 |

*Primary Examiner*—Ralph S. Kendall

*Attorney, Agent, or Firm*—Cameron, Kerkam, Sutton, Stowell & Stowell

[57] ABSTRACT

A process for coating an article such as a turbine blade composed of nickel-base alloy, comprises the steps of surrounding the article by a particulate pack in a chamber, the pack including coating material in elemental or chemically combined form, said coating material selected from the group comprising aluminium, chromium, titanium, zirconium tantalum, niobium, yttrium, rare earth metals, boron and silicon together with a halide activator, preferably of low volatility, and cyclically varying the pressure of an inert gas or a reducing gas or a mixture of said gases contained within said chamber, while maintaining the contents of the chamber at a temperature sufficient to transfer coating material onto the surface of the article and form a diffusion coating thereon.

14 Claims, 1 Drawing Figure

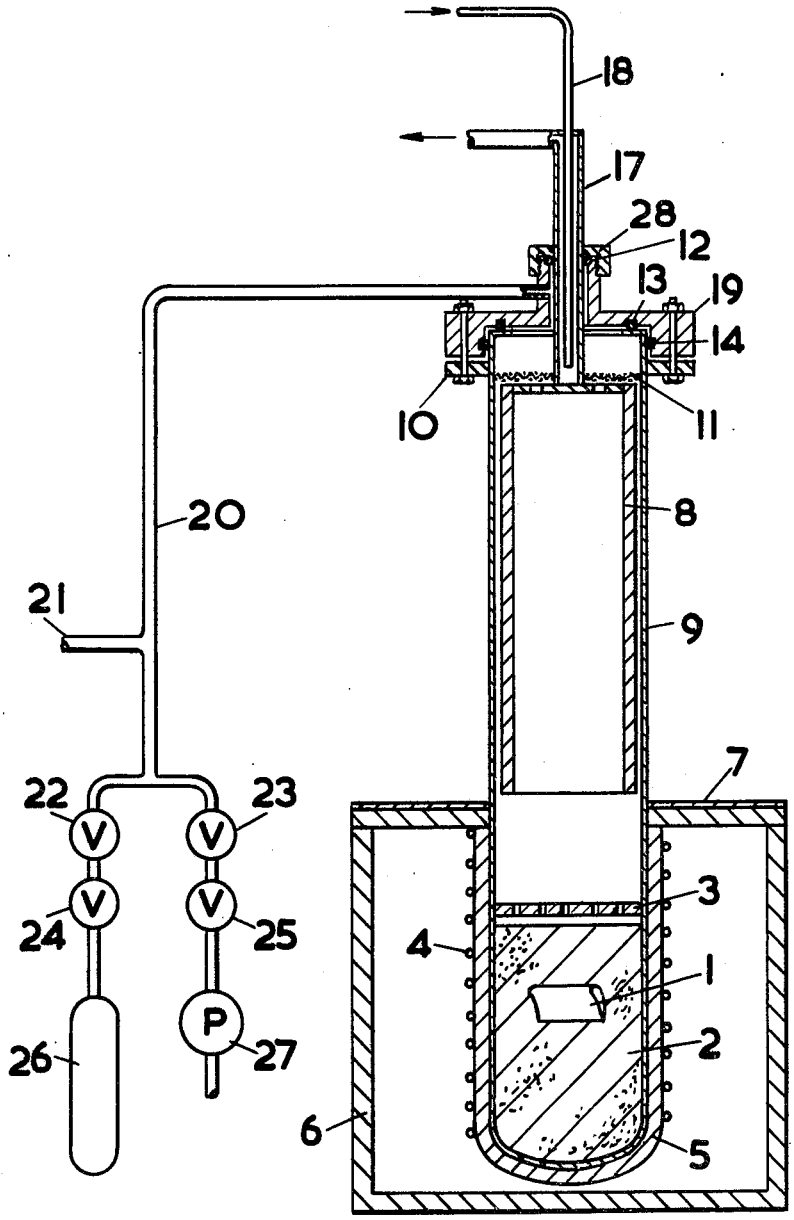
18
17
28
12
13
19
14
10
11
20
8
21
9
7
22
23
V
V
V
V
24
25
P
27
26
3
4
1
2
6
5

COATING ARTICLES HAVING FINE BORES OR NARROW CAVITIES IN A PACK-CEMENTATION PROCESS

This application is a continuation-in-part of copending application Ser. No. 672,952 filed Apr. 2, 1976, abandoned.

This invention relates to processes for coating articles with diffusion coatings and particularly, though not exclusively, relates to coatings for gas turbine engine components, e.g., turbine blades, for increasing their high temperature corrosion resistance.

It is known to produce metallide or metallised coatings by constant pressure, halide activated, pack-cementation. Aluminised and chromised coatings have been applied to nickel-based, cobalt-based, and iron-based substrates by this method.

A typical known pack-cementation process is described in U.S. Pat. No. 3,257,230 to Watchtell. A method of coating cobalt-base or nickel-base alloys is disclosed in which a pack comprising a metallic coating material such as aluminium, chromium, iron or silicon, a carrier comprising a halide source such as ammonium halide, and a moderator metal are packed around the article to be coated in a sealed retort and heated to between 760° and 1204° C. for 15 minutes to 40 hours. During this heating, the aluminium or other coating material is transported to the surface of the article and deposited thereon.

In such a process, the transport of halide vapour between the coating material and the article is primarily by diffusion, and as a consequence such a process is fairly slow and has relatively poor 'throwing power', i.e., the transport by diffusion of the halide vapours will only occur effectively over very short distances. When coating articles on their external surfaces, this poor 'throwing power' is usually not important, since by embedding the article to be coated in a particulate pack of the coating material the element which is to be transferred is in very close proximity of the article.

By contrast, the coating of internal surfaces such as bores is considerably more difficult to achieve by the pack cementation method. This is especially so in relation to the metallising of the surfaces of fine bores and cavities as are found for example in gas turbine engine components. U.S. Pat. No. 3,079,276 and British Pat. No. 1,315,228 describe the filling of holes and cavities of gas turbine engine components with a powder pack mix, but it is known that such practices are both difficult and time consuming to carry out and not always effective even for holes which are relatively large and of simple configuration.

It is also known to apply coatings of metals and compounds to internal surfaces by exposing the heated surfaces to a thermally decomposable metal plating gas such as nickel carbonyl and subjecting said gas to pulsating pressure as for example is described in British Pat. No. 1,070,396. Such a process merely deposits an overlay coating on the surfaces whereas in the case of gas turbine components particularly it is deemed most desirable that protective coatings are the result of interaction between the coating material and the article whereby an alloy or new compound is formed at the interface as is the case with pack cementation.

Hitherto pack cementation processes have been carried out in sealed leak-proof containers and the application of pulsating gas pressures involves converting a closed static system to an open dynamic one. Many of the commonly used halide activators, e.g., chlorides, bromides or iodides, are present entirely as vapour at the high temperatures of deposition and are no longer suitable since they would very quickly be lost from an open chamber. The system would thus be denuded of an essential coating constituent in a fraction of normal processing time and the coating process would cease to operate. There is no advantage in increasing the amount of halide activator since the halide vapour would be extremely corrosive of the valves, pumps and other components of the cycling equipment, and this would be most uneconomical if in fact the equipment could continue to operate throughout the coating process.

The present invention provides an improved process for producing diffusion coatings on an article by metalliding or metallising and is particularly applicable to coating fine bores or narrow cavities in gas turbine engine components and other articles.

According to the present invention a process for coating an article with a diffusion comprises enclosing the article in a chamber together with a particulate pack including coating material in elemental or chemically combined form, said coating material selected from the group consisting of aluminium, chromium, titanium, zirconium, tantalum, niobium, yttrium, rare earth metals, boron and silicon, together with a halide activator of low volatility and cyclically varying the pressure of an inert gas or a reducing gas or a mixture of said gases within the chamber whilst maintaining the contents of the chamber at a temperature sufficient to transfer coating metal onto the surface of the article and to form a diffusion coating thereon.

The halide activator is preferably selected from a group of inorganic halides wherein the equilibrium vapour, sublimation or dissociation pressure is equal to not more than atmospheric pressure at the coating process temperature, and advantageously from those in which this pressure is appreciably less than atmospheric. Examples of such low volatility halide activators are shown in Table 1. Preferably sufficient halide activator is used to ensure that some halide activator is retained in the pack at the end of the process.

TABLE 1

Equilibrium Vapour, Sublimation or Dissociation Pressures of Some Low Volatility Halide Activators

| Substance | Temp °C. | Pressure torr | Substance | Temp °C. | Pressure torr |
|---|---|---|---|---|---|
| $AlF_3$ | 927 | 1.3 | LiI | 827 | 47 |
| NaF | 927 | 0.1 | $CrF_3$ | 785 | 0.01 approx |
| NaCl | 927 | 2.4 | $CrF_2$ | 927 | 0.001 approx |
| NaBr | 927 | 4.8 | $CrCl_2$ | 927 | 5.0 |
| NaI | 927 | 15.0 | $CrBr_2$ | 810 | 0.9 |
| KF | 927 | 1.2 | $CrI_2$ | 793 | 1.4 |
| KCl | 927 | 4.0 | $CoF_2$ | 927 | 0.05 |
| KBr | 927 | 6.5 | $FeF_2$ | 927 | 0.02 |
| KI | 927 | 12.3 | | | |

Activators of higher volatility are shown in Table 2.

TABLE 2

Equilibrium Vapour, Sublimation or Dissociation Pressures of Some High Volatility Halide Activators

| Substance | Temp °C. | Pressure torr | Substance | Temp °C. | Pressure torr |
|---|---|---|---|---|---|
| $Cl_2$ | =34 | 760 | $NH_4Br$ | 397 | 760 |
| $Br_2$ | 61 | 760 | | | |
| $I_2$ | 183 | 760 | $AlCl_3$ | 180 | 760 |
| HCl | −167 | 760 | $AlBr_3$ | 225 | 760 |
| HBr | −35 | 760 | $AlI_3$ | 385 | 760 |
| HI | 100 | 760 | $FeCl_3$ | 319 | 760 |

TABLE 2-continued

Equilibrium Vapour, Sublimation or Dissociation Pressures of Some High Volatility Halide Activators

| Substance | Temp °C. | Pressure torr | Substance | Temp °C. | Pressure torr |
|---|---|---|---|---|---|
| $NH_4F$ | — | 760 | $FeCl_2$ | 934 | 760 |
| $NH_4Cl$ | 397 | 760 | $FeBr_2$ | 927 | 570 |

Preferably the method according to the invention is effectively carried out at a maximum pressure substantially below atmospheric pressure and most advantageously below about 100 torr. There are two main reasons for this.

One is that correspondingly larger volumes of gas for producing pressure variations are required with higher maximum pressures, the vapour pressure of the halide activator being substantially constant at $10^{-2}$ atmospheres or less and constituting an almost insignificant proportion of the total pressure. In the course of a cycle the extra gas has to be heated from ambient to the operating temperature of the process and likewise cooled. This will affect the pack temperature, which can upset the process, and is also likely to cause problems in maintaining the whole of the chamber at an even temperature. Additionally, larger quantities of gas cannot be added or withdrawn so quickly, thus further slowing the process.

The other main reason also derives from the relationship of vapour pressure to total pressure. If Ph and Pi are the respective values of the halide and the pressurising gas (total pressure$=P_h+P_i$), the initial amount of halide in a hole is equal to $P_hV/RT$ where V is the volume of the hole.

If $P_i$ is halved, an amount of halide equal to $P_hV/2RT$ will leave the hole and if $P_i$ is reduced to one third the equivalent amount of halide becomes $P_hV/3RT$. This is true whatever the initial value of $P_i$ and it follows that there is no advantage to be gained from high values, especially in the light of the considerations previously discussed. Low pressures also naturally assist the diffusion transport of a halide of low vapour pressure.

Another advantage is that large changes of pressure are not involved and the magnitude of alternating stresses on the chamber is consequently less and so design is a relatively simple matter.

Preferably the cycle frequency is as high as is compatible with the transport of a sufficient quantity of the gas through the particulate pack per cycle. The ratio of upper pressure limit to lower pressure limit is also preferably as high as is practicable and consistent with cycle frequency. Convenient pressure ranges are from about 50 torr to about 10 torr, preferably with cycle frequencies of at least 2 cycles per minute. In general, higher frequencies are beneficial in increasing the ratio of coating thickness applied internally to that applied externally.

The choice of halide activator must also take into account factors other than volatility. In particular, the activator must also be capable of entering into the necessary chemical equilibria which will lead to the to-and-fro gas transport and proper interaction with the coating material and the article to be coated, at the coating temperature which must not exceed the temperature at which significant degradation of the properties of the article occurs. In the case of certain nickel-base and cobalt-base alloys, for example, significant degradation can occur at coating temperatures above about 900° C. Other halides which may be used in the process of the invention are double halides, for example sodium cryolite, $Na_3AlF_6$. It may also be desirable to employ a mixture of halide activators, for example NaF/NaCl-/NaBr or KF/NaF/LiF to increase the efficiency of the deposition process.

When producing aluminised coatings by the method of the invention, aluminium fluoride, $AlF_3$, has been found to be particularly effective, good quality aluminised coatings of satisfactory uniformity and distribution having been obtained on both internal and external surfaces of nickel-base gas turbine blades. Preferably the proportions of the aluminium source material (coating material) and aluminium trifluoride are such that aluminium trifluoride crystals are not formed.

The particulate pack may include a filler such as a refractory oxide for support of the coating material or for dilution of the pack. A filler comprising a refractory oxide may support a coating material comprising liquid aluminium.

The articles coated by the process may be composed of any material that can be coated by pack cementation. Materials commonly coated by pack cementation are nickel-base, cobalt-base and iron-base alloys, and the refractory metals of groups IV, V, and VI of the Periodic Table. In addition to these materials, carbon and carbon-containing materials, e.g., tungsten carbide, may be advantageously coated by the process. In particular, titanium carbide coatings may be produced on a cemented carbide article.

In one manner of operating the process in accordance with the invention, the article to be coated is kept out of physical contact with the particulate bed. This could be by placing the article inside a cage which is itself embedded within the particulate pack. A preferred construction for a cage is one that will permit vapours to pass from the particulate pack to the inside of the cage but which prevents or retards flow to the outside of the cage. One cage according to the invention has sides and an upper face of imperforate material, e.g., nickel sheet or plate, and the base of a mesh or gauze through which vapour can pass.

Alternatively, the article to be coated may be suspended in the reaction chamber over a tray containing the particulate pack material.

An example of apparatus for use in a process in accordance with the invention will now be described with reference to the accompanying drawing which shows a leak-tight chamber and auxiliary plant for varying the internal pressure of the chamber.

Referring to the drawing, the chamber includes a furnace tube 9 composed of mullite surrounded at its lower end by an alumina tube 5 surrounded in turn by an electrical heating element 4 and standing in a thermally insulated box 6 which has a nickel foil heat shield 7 on its upper surface. A gas turbine blade 1 of nickel-base alloy which is to be coated is located in a pack 2 comprising a powder mixture retained in the furnace tube 9 by a metal disc 3.

The furnace tube 9 is connected by a pipe 20 to auxiliary equipment for continuously varying the pressure in the tube 9. The auxiliary equipment comprises a supply of gas 26 and a vacuum pump 27 connected to the pipe 20 by time controlled valves 24, 25 and needle valves 22, 23 respectively. A mercury manometer (not shown) is connected to a branch 21 of the pipe 20 and is used for measuring the pressure fluctuations in the furnace tube 9.

The upper part of the furnace tube 9 is closed by an end plate 19 which is bolted to a flange 10 on the furnace tube. A pair of O-ring seals 13, 14 provide gas tight sealing between the end plate 19 and the furnace tube. A screw cap 28 engages with a thread on a cylindrical part of the end place 19 and has an O-ring seal 12 which provides a gas tight seal between the end plate and the tube 17 which extends through the screw cap 28.

The upper part of the furnace tube 9 is water cooled, the water flowing through a copper pipe 18 to the upper end of the furnace tube. A stainless steel tube 17 surrounding the tube 18 carries the return water flow. A nickel gauze 11 in good thermal contact with the end of the coolant tube 17 extends over the end of the nickel tube 8, which apart from two small holes on the upper face, is closed to the chamber gases. The temperature of the pack is sensed by a thermocouple (not shown).

The method according to the invention is illustrated by the following examples:

EXAMPLE 1

A gas turbine blade section in 'IN 100' alloy, bearing a hole of diameter about 1.5mm and of length about 110mm, was aluminised according to the method of the invention in a chamber. The method included embedding the blade section in a powder mix of 14 grams $AlF_3$, 14 grams Al and 388 grams $Al_2O_3$, pumping out the chamber and admitting argon to displace any air, raising the temperature of the chamber and its contents to 900° C. and setting the time-controlled valves to give a flow of argon into the chamber for 3 seconds to give a pressure of 28 torr, maintain this pressure substantially constant for 20 seconds and then exhaust for 7 seconds to reduce the pressure to about 6 torr, after which the cycle was repeated automatically. After 10 hours at the same temperature, the chamber was cooled and the blade section removed. On examination, the surface of the hole was found to be uniformly coated with an aluminised layer of mean thickness about 35 μm. The thickness distribution of the coating along the length of the hole can be seen from the following figures:

Distance from one end of hole (mm): 10 20 30 40 50
Coating thickness (μm): 40 40 35 30 30

EXAMPLE 2

In a further example, a turbine blade in 'IN 100' alloy bearing holes of diameter about 1.5mm and of length about 70mm, was aluminised for 5 hours at 900° C. inside a nickel gauze cage which was itself embedded in a powder pack mix of 6.5 grams $AlF_3$, 10.6 grams Al and 330 grams $Al_2O_3$. The pressure range of argon was from 14 to 58 torr and the pressure cycle frequency was 6 cycles minute $^{-1}$. Bright metallic-looking and particularly smooth textured aluminised layers were produced on both the internal and external surfaces of the blade. The layer thickness within the hole measured close to the top, mid-span and bottom was respectively 12, 8 and 12 μm. The layer thickness measured over the external surface at comparable positions was 25, 25 and 30 μm respectively.

EXAMPLE 3

In a further example a turbine blade in 'Nimonic 105' alloy bearing holes of two differing cross sections, about 0.8 and 1.5mm, but of the same length about 60mm, was aluminised for 6 hours at 900° C. inside a nickel gauze cage which was itself embedded in a powder pack mix of 6.6 grams $AlF_3$, 10.5 grams Al and 330 grams $Al_2O_3$. The pressure range of argon was from 4 to 44 torr and the pressure cycle frequency was 6 cycles minute$^{-1}$. Aluminised layers of quality similar to those obtained in the preceding example were produced on both the internal and external surfaces of the blade. The internal surface of the larger cross section hole had thicknesses of 30, 20 and 20 μm respectively at the top, mid-span and bottom positions. The corresponding thicknesses for the smaller cross section hole was 15, 12 and 15μm. External thicknesses at about the same positions were 65, 60 and 60μm respectively.

EXAMPLE 4

In yet a further example of aluminising with $AlF_3$, a turbine blade in 'MAR-M 246' alloy, bearing holes of two different cross sections, one with major and minor axes of about 2 and 0.5mm and the other of diameter about 2mm, but both of length about 60mm, were aluminised for 5 hours at 900° C. inside a nickel gauze cage which was itself embedded in a powder pack mix of 6.6 grams $AlF_3$, 10.6 grams Al and 330 grams $Al_2O_3$. The pressure range of argon was from 12 to 52 torr and the pressure cycle frequency was 6 cycles minute$^{-1}$. Similar quality aluminised layers were produced on both the internal and external surfaces of the blade. The internal layer thickness along the length of the approximately elliptical section was 20, 15 and 25μm close to the top, mid-span and bottom positions. The corresponding figures for the circular cross section were 40, 40 and 45μm. Corresponding figures for the external surface were 60, 65 and 65μm.

EXAMPLE 5

In an example of aluminising with NaCl as halide activator, a turbine blade in 'IN 100' alloy was aluminised for 5 hours at 900° C. within a nickel gauze cage which was itself embedded in a powder pack mix of 20 grams NaCl, 14 grams Al and 300 grams $Al_2O_3$. The pressure range of argon was from 8 torr to 42 torr and the pressure cycle frequency was 6 cycles minute$^{-1}$. A layer of thickness 2μm was produced within a hole of diameter 1.8mm and of length 40mm. The thickness of the external layer was about 16μm.

EXAMPLE 6

In an example of aluminising with NaF as halide activator, an alloy section in 'IN 100' was aluminised for 5 hours at 900° C. within a nickel gauze cage which was itself embedded in a powder pack mix of 14.7 grams NaF, 13.6 grams Al and 330 grams $Al_2O_3$. The pressure range of argon was from 12 to 56 torr and the pressure cycle frequency was 6 cycles minute$^{-1}$. An aluminised layer of thickness 8μm was produced within a hole of diameter about 1mm and of length about 40mm. The aluminised layer thickness over the external surface was about 30μm.

The process of the invention may be used to apply to the internal and external surfaces of articles various other types of diffusion coatings which hitherto have been applied by conventional pack cementation processes e.g., chromising, titanising, tantaliding, boronising and siliconising.

Inert gases other than argon may be employed, and with some of these processes, notably chromising, it could be advantageous to use hydrogen, which will act as a reducing agent, either mixed with an inert gas or alone.

To one skilled in the art, it will be appreciated that some activators may respond better than others to a particular metallising process, and some care must therefore be exercised in the choice of activators. Activators of low volatility that are not readily available, may be synthesised within or outside the coating chamber prior to operation of the coating step and introduced into the pack. In one embodiment of the invention, $SiCl_2$ is synthesised from silicon and ammonium chloride, for use in siliconising.

We claim:

1. A process for coating an article having fine bores or narrow cavities with a diffusion coating comprising the following steps:

a. enclosing the article in a chamber together with a particulate pack including a coating material in elemental or chemically combined form, said coating material selected from the group consisting of aluminium, chromium, titanium, zirconium, tantalum, niobium, yttrium, rate earth metals, boron and silicon, together with a halide activator of low volatility, b. introducing an inert gas into the chamber, and c. cyclically varying the pressure of said gas within the range 0–100 torr at a rate of not less than 2 cycles per minute whilst maintaining said pack and article at a temperature sufficient to transfer said coating material on to the surface of said article to form a diffusion coating therewith.

2. A process as in claim 1 wherein the vapour, sublimation or dissociation pressure of the halide activator does not exceed atmospheric pressure at said temperature.

3. A process as in claim 1 wherein the vapour, sublimation or dissociation pressure of the halide activator does not exceed 15 torr at a temperature of 900° C.

4. A process as in claim 1 wherein the maximum pressure of the gas does not exceed 100 torr.

5. A process as in claim 1 wherein the maximum pressure of the gas is about 50 torr and the minimum pressure is about 10 torr.

6. A process as in claim 1 wherein said coating material comprises aluminium and the halide activator comprises aluminium fluoride.

7. A process as in claim 1 wherein said coating material comprises aluminium and said halide activator comprises sodium chloride.

8. A process as in claim 1 wherein said coating material comprises aluminium and said halide activator comprises sodium fluoride.

9. A process as in claim 1 wherein the pack includes a filler for supporting the coating material.

10. A process in claim 9 wherein the filler comprises a refractory oxide.

11. A process as in claim 10 wherein the refractory oxide is aluminium oxide.

12. A process as in claim 1 wherein the article is held out of contact with said particulate pack in a cage permitting vapour to pass from the particulate pack to the inside of the cage but retarding flow to the outside of the cage.

13. A process for coating a metallic article having fine bores or narrow cavities with a diffusion coating comprising the following steps:

a. surrounding the article by a particulate pack in a chamber, the pack including coating material in elemental or chemically combined form, said coating material selected from the group consisting of aluminium, chromium, titanium, zirconium, tantalum, nobium, yttrium, rate earth metals, boron and silicon, b. introducing an inert gas or a reducing gas or a mixture of said gases into the chamber, c. introducing a vapour comprising a halide activator of low volatility into the chamber, and d. cyclically varying the pressure of said gas or gases within the range of 0–100 torr at a rate of not less than 2 cycles per minute whilst maintaining said pack and article at a temperature sufficient to transfer said coating material on to said article and form a diffusion coating thereon.

14. A process as in claim 13 wherein the reducing gas comprises hydrogen.

* * * * *